US005090394A

United States Patent [19]

Bruckelt et al.

[11] Patent Number: 5,090,394

[45] Date of Patent: Feb. 25, 1992

[54] DISTRIBUTORLESS IGNITION SYSTEM

[75] Inventors: Alfred Bruckelt, Steinheim; Günther Kaiser, Stuttgart; Immanuel Krauter, Erbstetten; Karl Ott, Markgröningen, all of Fed. Rep. of Germany

[73] Assignee: Robert Bosch GmbH, Stuttgart, Fed. Rep. of Germany

[21] Appl. No.: 635,138

[22] PCT Filed: Jun. 16, 1989

[86] PCT No.: PCT/EP89/00681

§ 371 Date: Dec. 28, 1990

§ 102(e) Date: Dec. 28, 1990

[87] PCT Pub. No.: WO90/15926

PCT Pub. Date: Dec. 27, 1990

[51] Int. Cl.[5] ..... F02P 5/15

[52] U.S. Cl. ..... 123/643; 123/630

[58] Field of Search ..... 123/179 BG, 417, 418, 123/612, 613, 617, 625, 630, 643

[56] References Cited

U.S. PATENT DOCUMENTS

| | | | |
|---|---|---|---|
| 4,044,747 | 8/1977 | Longstaff | 123/643 |
| 4,265,211 | 5/1981 | Meloeny | 123/643 |
| 4,432,323 | 2/1984 | Iwasaki | 123/643 X |
| 4,502,441 | 3/1985 | Katayama et al. | 123/643 X |
| 4,690,124 | 9/1987 | Higashiyama | 123/179 BG X |
| 4,711,227 | 12/1987 | Li et al. | 123/643 |
| 4,960,092 | 10/1990 | Sasaki et al. | 123/643 X |
| 4,979,487 | 12/1990 | Fukui | 123/643 |
| 5,042,449 | 8/1991 | Dassetto | 123/630 X |

*Primary Examiner*—Willis R. Wolfe
*Attorney, Agent, or Firm*—Michael J. Striker

[57] ABSTRACT

A distributorless ignition system for an internal combustion engine includes one spark coil for cylinder of the engine, a first reference signal generator for producing a first signal indicative of each revolution of the engine, a second reference signal generator for producing a second signal indicative of every second revolution of the engine, and a processor for evaluating the advance and dwell angles of an ignition pulse to a selected spark coil determined from a logical combination of the first and second signals. During starting, the processor is arranged to operate in a dual-spark mode for the first revolution of the engine and produce two ignition pulses simultaneously for each first signal, one to each of two cylinders which are 360° out of phase with each other. During running of the engine, the second reference signal generator is monitored and, if found to be faulty, the processor changes from a one-spark mode to a dual-spark mode.

6 Claims, 4 Drawing Sheets

DISTRIBUTORLESS IGNITION SYSTEM

BACKGROUND OF THE INVENTION

The present invention relates to distributorless ignition systems for internal combustion engines.

In an ignition system with non-rotary high-voltage spark distribution, usually called a distributorless ignition system, and one ignition coil per cylinder of the engine, it is usually necessary to provide two reference signals in order to unambiguously distinguish each of the cylinders. One of the reference signals is usually indicative of top dead center (TDC) of number 1 cylinder and is derived from the crankshaft. The other reference signal is required due to the fact that with a four stroke cycle, for each cylinder there are two TDC positions but only one spark is required. Consequently, a so-called "phase" signal is required which, when logically combined with the TDC reference signal, indicates the unambiguous position of the number 1 cylinder and hence each of the other cylinders. This "phase" signal is usually derived from the crankshaft every 720° of crankshaft rotation.

It is absolutely necessary to check the phase signal at the start and during engine operation for logical correctness (for example phase signal present and not present in each case at successive reference marks, proper angular position with respect to reference mark) since an incorrect phase signal can lead to the drive to the ignition coils being offset by 360° of crankshaft rotation and thus to an ignition of the mixture in the exhaust phase. Since this diagnosis of the phase transmitter requires monitoring of the reference mark transmitter and the phase transmitter over at least 360° of crankshaft rotation even at the start of the engine before the first ignition is triggered, the starting times are significantly extended.

The present invention provides an ignition system for an internal combustion engine comprising means for generating a first signal indicative of a rotational position of the engine, means for generating a second signal indicative of a further rotational position of the engine, a plurality of ignition coils equal in number to or a multiple of, the number of cylinders in the engine, and computation means for computing and outputting ignition signals in response to the first signal. The ignition system according to the invention is characterized in that the computation means is arranged to address two cylinders of the engine at the same time, and to apply an ignition signal to a coil or coils associated with each of the two cylinders in the absence of a predetermined logical combination of the first and second signals.

This arrangement overcomes the disadvantage of extended starting times due to the fact that sparks are generated during the first revolution of the engine and until correct phasing of the ignition occurs. Should any fault occur in the means for detecting the second (phase) signal while the engine is running, it is possible to cause the processor to use the control method normally used for dual-spark coils as this will permit the engine to continue to operate although at some cost in terms of wear on the spark plug.

In order that the present invention be more readily understood an embodiment thereof will now be described by way of example with reference to the accompanying drawings, in which:

DETAILED DESCRIPTION OF THE PREFERRED EMBODIMENT

In the embodiment to be described, only a non-rotary high-voltage distribution ignition system for a four stroke engine will be described. It is to be noted that the ignition system could be combined with another system such as a fuel injection system.

Figure 1:
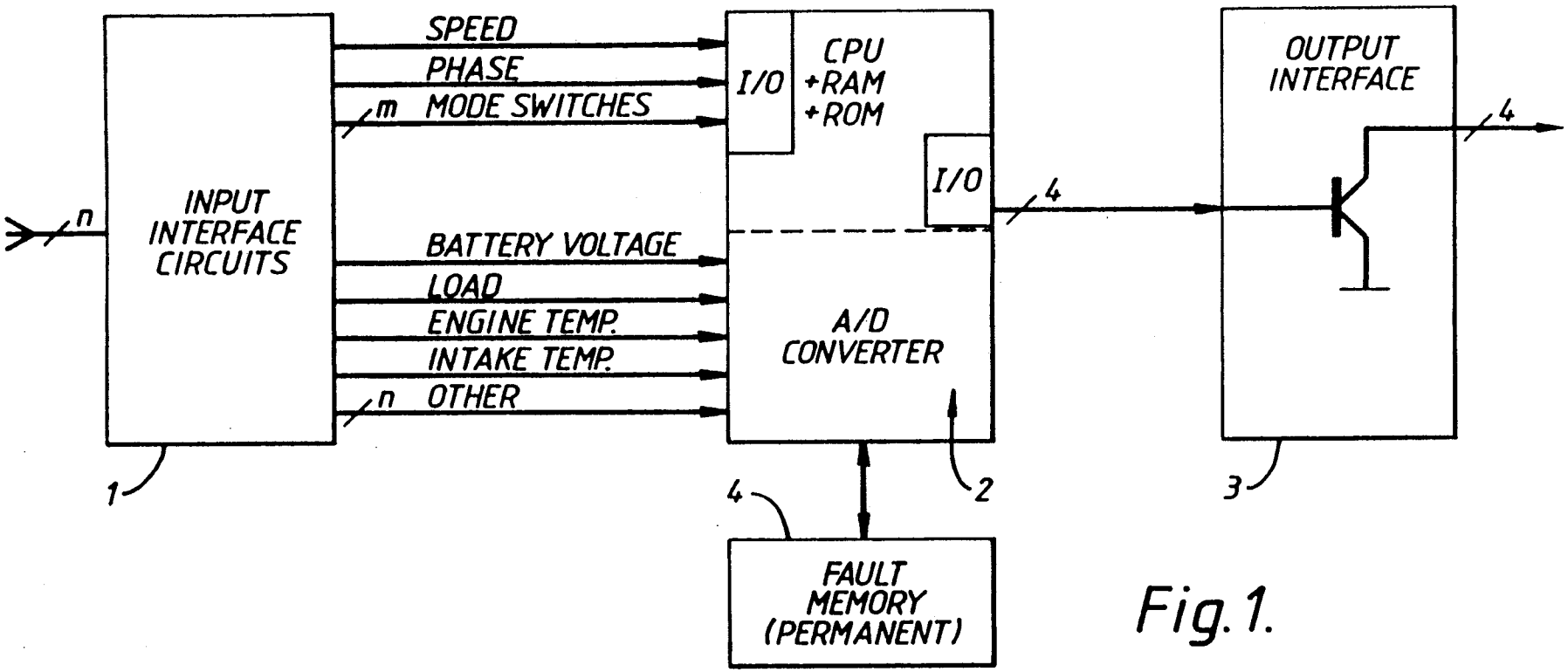
FIG. 1 shows a diagrammatic flow chart of a basic distributorless ignition system.

Referring now to FIG. 1, a microcomputer-controlled ignition system contains at least the circuit components of input interface (1), microcontroller with on-board RAM/ROM and A/D converter (2) and output interface circuits (3) for driving a plurality of ignition coils, one for each cylinder. It is of advantage for workshop diagnosis of such ignition systems if the microcontroller (2) is equipped with a permanent memory (4) for permanently storing faults diagnosed during engine operation. Such a permanent fault memory can be implemented, for example, with the aid of a battery-buffered RAM or of an EEPROM or of a microcontroller with power-down mode.

In this arrangement, the input interface circuits (1) have the task of suitably editing the signals required for controlling the ignition time and dwell angle such as speed of rotation, load, engine temperature, intake air temperature, battery voltage, phase, switch signals and so forth for the microcontroller.

In the case of the speed signal, the assumption is made, without restricting the invention, that it is the known one-transmitter increment Motronic system which enables speed and reference mark to be detected by a single sensor. In the case of the phase signal, it is assumed in the illustrative embodiment that it is generated by a Hall effect sensor adjusted in such a manner that a signal is, generated by the Hall sensor every 720° of crankshaft rotation and coincides with a gap in the speed signal. However, sensors operating in accordance with the most varied principles such as, for example, in accordance with the inductive transmitter principle, can be used a variation of the method and apparatus described. The only prerequisite is that the phase signal exhibits a particular period with respect to the crankshaft rotation when the sensor is operating properly. In particular, the switching over of the ignition system according to the invention between one-spark operation (with correctly operating phase sensor) and two-spark operation (with faulty phase sensor) is unaffected by this.

The microcontroller (2) measures the processed input signals in the known manner and stores the instantaneous operating parameters of the engine, obtained from these signals, in its RAM. Using the input parameters found, the control program stored in the ROM of the microcontroller then calculates the optimum ignition and dwell angle for any operational condition of the engine with the aid of stored formulae, tables, characteristics and families of curves. Conversion of the calculated ignition and dwell angles into drive signals for the output interface circuits (3) occurs in the microcontroller with the aid of integrated timer/counter circuits.

The output interface circuits (3) provide the required current for the ignition coils via appropriate output stages by means of the drive signals supplied by the microcontroller.

Figure 2:
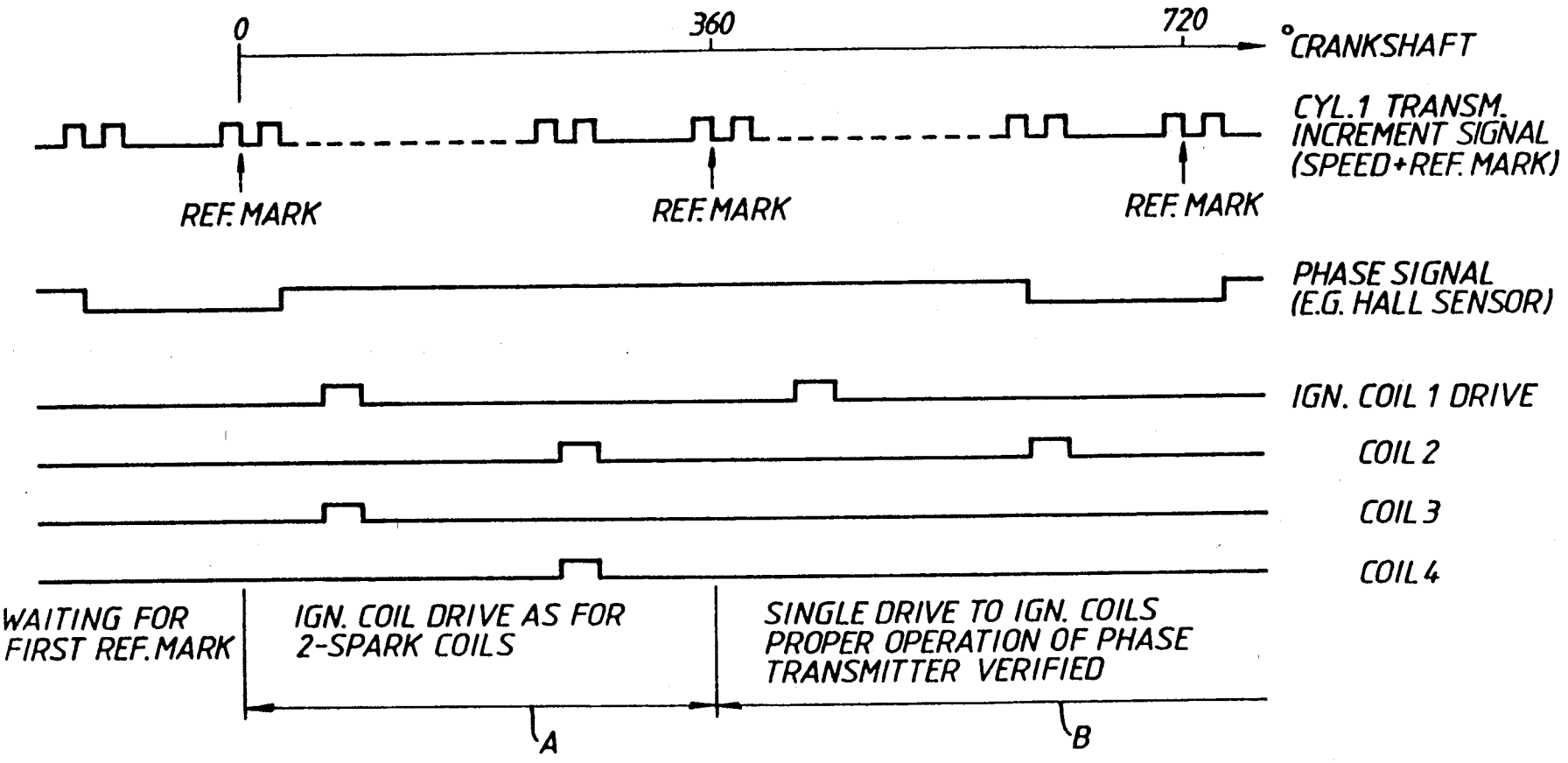
FIG. 2 shows a timing diagram of the operation of the ignition system of explaining the present invention.

When the system is started, the ignition system is always operated in a so-called two-spark mode until proper operation of the phase sensor is detected. In this mode, two ignition coils belonging to two cylinders operating offset by 360° of crankshaft rotation in the working cycle are in each case driven at the same time; that is to say in each case in the working cycle following the detection of the gap/reference mark from the speed sensor, ignition of cylinder 1 and 3 is triggered and 180° of crankshaft rotation later the ignition of cylinder 2 and 4. This procedure corresponds to the method used when operating an ignition system equipped with so-called dual-spark ignition coils and is shown in FIG. 2 during period A.

If diagnosis of the phase signal shows proper functioning of the phase sensor, the ignition system is operated in one-spark mode or switched over from two-spark mode to one-spark mode. In this arrangement, the ignition coils belonging to the individual cylinders of the engine are individually and successively actuated in the ignition sequence depending on the respective engine design (usual control method with non-rotary high-voltage distribution with single-spark ignition coils). This is represented by period B in FIG. 2. If a defect of the phase sensor is detected during operation of the engine, the ignition system is operated in two-spark mode again until the sensor is operating properly again.

Figure 3:
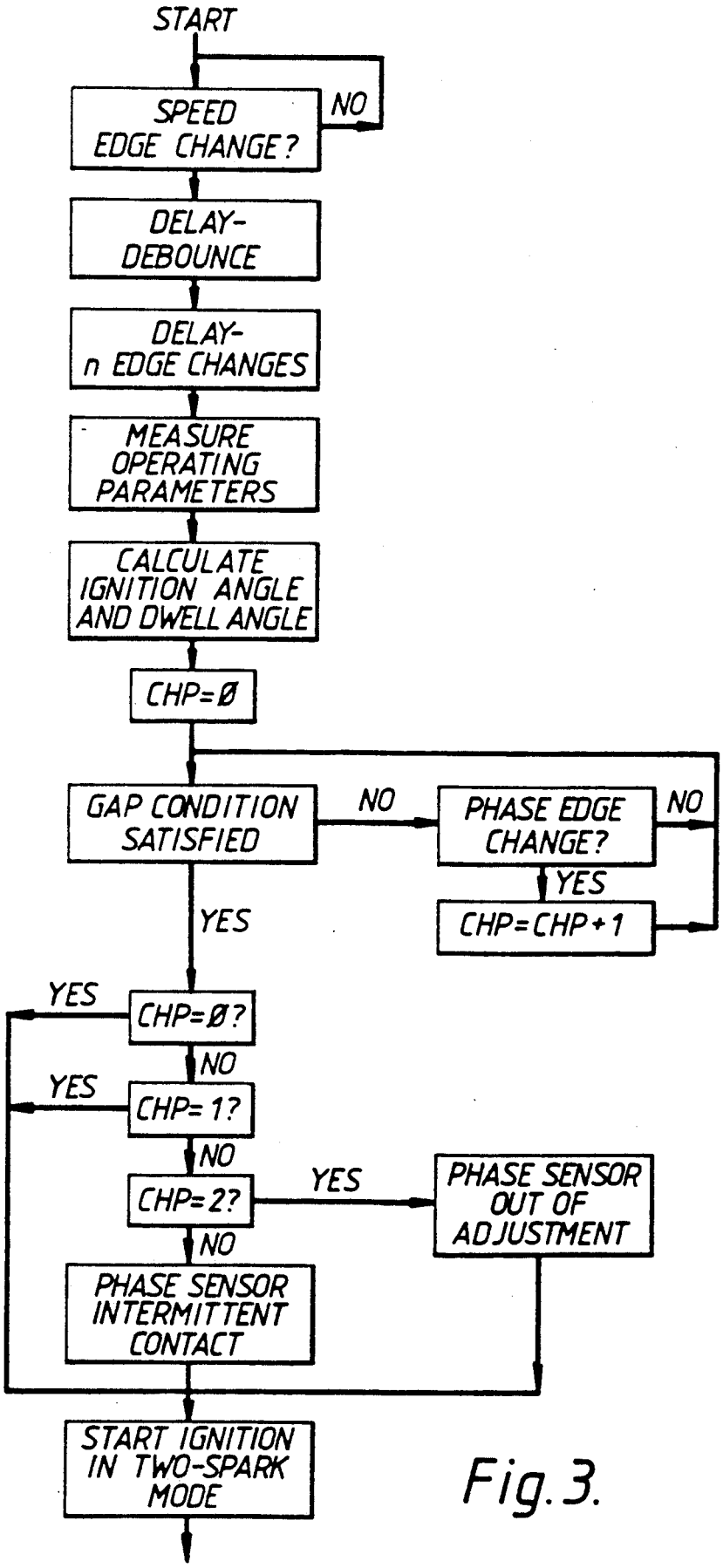
FIG. 3 is a flow chart how the system of FIG. 1 operates to provide the spark timings shown in FIG. 2.
Figure 4:
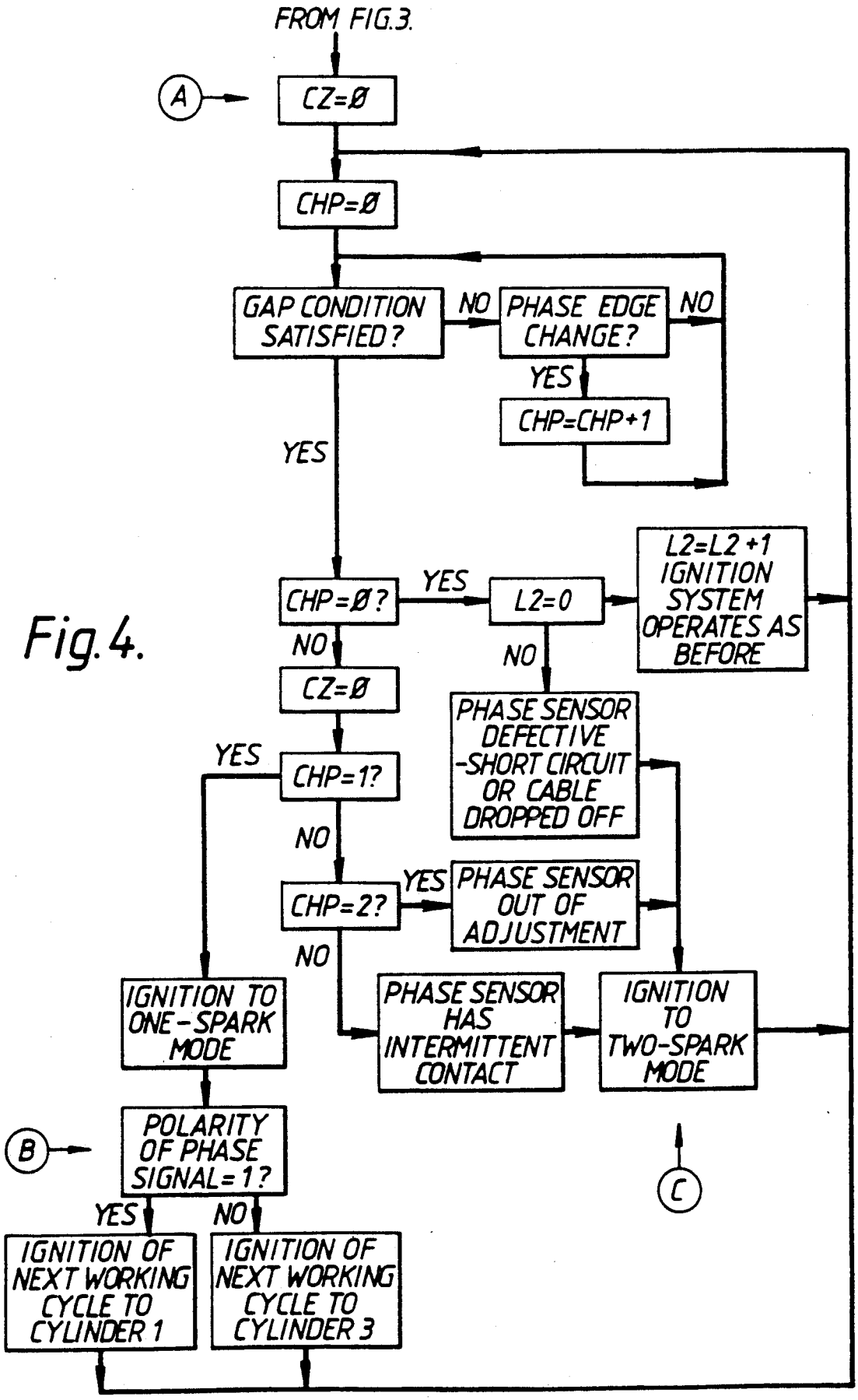
FIG. 4 is a flow chart explaining how the system of FIG. 1 operates during running conditions.

The "start mode" and "normal mode" flow charts ar shown in FIGS. 3 and 4 respectively and describe by way of example for a four-cylinder engine the monitoring procedures of the phase signal applied by the sensor, necessary during the starting process and normal running engine operation, and the switchover of the ignition system between one-spark mode and two-spark mode, derived from the diagnosis of the phase signal.

Referring now to FIG. 3, after "ignition on" (switching device at battery voltage or ignition switch), ignition systems usually detect commencement of rotation of the engine driven by the starter by interrogating the speed signal for a change of edge. To prevent wrong measurement of the engine signals due to electrical interference in the on-board system during the first starting phase, detection of the speed signal is normally suppressed for a certain so-called de-bouncing time after detection of the first speed signal edge and, after this time has lapsed, a certain number of speed signal edges are counted until measuring of the engine signals required for control of the ignition system is begun. From the measured engine signals, the control program then calculates the engine operating parameters and, using these, provides the variables "ignition angle" and "dwell angle" required for driving the ignition coils. At this point, a counter, (CHP), which is to be incremented later with each change of edge of the phase signal, is reset, advantageously to zero.

The control program then begins with the synchronisation to the gap of the speed transmitter signal (or of the reference mark search) which is absolutely necessary for driving the ignition coils. This process is known and, therefore will not be described in greater detail at this point. It is necessary for the diagnosis of the phase sensor that during this process each change of edge of the phase signal is registered via an incrementation of the counter CHP.

The phase signal provides information indicating from which cylinder the next ignition is to come. In other words, the phase sensor signal is assigned to a certain cylinder and only occurs in the undisturbed state once per 720° of crank shaft revolution. When the phase sensor is operating correctly, the relationship between the phase signal and the speed signal is such that only one change of edge of the phase signal occurs between any two successive reference marks in the speed signal, as shown in FIG. 2. The reference mark is generated at a particular crankshaft position, e.g.: top dead centre position at cylinder 1.

After the gap condition from the speed sensor has been satisfied, or the reference mark detected, for the first time, the content of counter CHP is evaluated to monitor the operation of the phase detector. With more than one detected change of edge of the phase signal between two succesive reference marks, it can be assumed that the phase sensor is not properly operating and a clear assignment to a certain cylinder is not possible. With two observed changes of edge of the phase signal, a maladjusted phase transmitter can be assumed, with more than two changes of edge an intermittent contact of the phase sensor or a disturbance of the signal, for example by EM1 influences, can be assumed. Likewise if no phase signal is detected (i.e.: the phase signal is always "high" or "low") malfunctioning of the phase transmitter can be assumed. Again, assignment to a certain cylinder is not possible.

If single faults of the system must also be stored in the permanent fault memory, the observed malfunction can already be noted in the permanent fault memory. If faults must occur several times before being entered in the permanent fault memory, the observed malfunction is only registered in a fault memory in the RAM of the CPU.

If only one or no change of edge of the phase sensor signal is observed, no statement can yet be made about the proper functioning of the phase transmitter.

However, independently of the outcome of this diagnosis, it is recommended to operate the ignition system in two-spark mode during the first crankshaft rotation and to decide only after the first crankshaft rotation has been completed and the informative diagnosis of the phase signal is then present, whether transfer to one-spark mode of the ignition system is to be carried out. This is shown in FIG. 3.

FIG. 4 shows how the microcontroller is arranged to monitor the phase sensor after the completed first crankshaft rotation of the fired engine and during normal operation of the engine. The counter CHP must be reset, preferably to zero, at the beginning of the monitoring routine of the phase sensor (point A in FIG. 4). Each change of edge of the phase signal will continue to be registered via an incrementation of the counter CHP.

After the gap condition has been satisfied, the count of counter CHP is interrogated each time. With a correctly adjusted properly operating phase transmitter, a single change of edge of the phase transmitter must be observed within one specified crankshaft rotation (e.g.: cylinder 1 TDC to cylinder 1 TDC). It is then possible to operate the ignition system in one-spark mode or to switch over from two-spark mode to one-spark mode.

In this arrangement, the polarity of the signal of the phase transmitter, measured during the satisfied gap condition, can be used for deciding whether the ignition to be triggered in the next working cycle has to be conducted to cylinder 1 or 3 (point B in FIG. 4).

If two changes of edge of the phase signal are observed within a single crankshaft rotation, a mal-adjusted phase sensor must be assumed. The ignition system is then logically operated in two-spark mode (point C in FIG. 4). If no single change of edge of the phase signal is observed within one crankshaft revolution, the phase sensor either has a short circuit to earth or to battery voltage or the plug of the transmitter has fallen out or the phase transmitter is mal-adjusted. The latter case can be decided by observing the phase transmitter signal over two crankshaft revolution. For this purpose counter L2 is used in an easily obvious manner for counting the crankshaft roations. In each case, the ignition system operation is continued in two-spark mode or switches from one-spark mode to two-spark mode If more than two changes of edge of the phase signal are observed within one crankshaft revolution, an intermittent contact of the phase sensor must be assumed. The ignition system is operated in two-spark mode.

The above system can be modified to use multiple ignition coils per cylinder in which case each ignition coil of the multiple coils of each cylinder can be controlled to operate separately or simultaneously. Further, when the dwell angle is large at low speeds i.e. idling, rather than a single ignition pulse, a series of short pulses can be applied to the ignition coil or coils of each cylinder.

The above described embodiment of the inventions relies on the use of a phase sensor signal which exhibits an "edge change" or change of state between successive reference marks in the speed signal. However the use of this type of signal is not essential to the invention.

The phase sensor may consist of a single short pulse once every 720° of rotation of the crankshaft. Such a signal might be derived, for example, from a Hall sensor provided on the camshaft which operates the intake and exhaust valves. The camshaft rotates at half the speed of the crankshaft. In this case an alternative system according to the invention may be used.

According to one such alternative system the operation of the phase sensor is diagnosed in a single rotation or the camshaft of 720° crankshaft revolution. As mentioned above the phase signal provides information indicating from which cylinder the next ignition is to come. With correct operation of the phase sensor the signal occurs only once in 720° of crankshaft rotation. The number of phase signals occuring per 720° rotation of the crankshaft is detected by suitable means to test the operation of the phase sensor. Two different fault conditions can be identified. More than one phase signal may be detected during 720° of crankshaft rotation due, for example, to interence affecting the phase line. In this case, a clear assignment to a certain cylinder is not possible and, if the engine has just started, two-spark mode is maintained or if the engine is running, the operation is switched to two-spark mode. It is possible that no phase sensor signal will be detected during 720° of crankshaft rotation (signal always "high" or "low"). Again no assignment to a certain cylinder is possible and two-spark operation is maintained or switched in.

We claim:

1. An ignition system for an internal combustion engine, comprising means for generating a first signal indicative of a rotational position of the engine; means for generating a second signal indicative of a further rotation position of the engine; a plurality of ignition coils equal in number to at least a part of the number of cylinders in the engine; and computation means for computing and outputting ignition signals in response to said first signal; said computation means being arranged to address two cylinders of the engine at the same time and to apply an ignition signal to an ignition coil or coils associated with each of said two cylinders in the absence of a predetermined logical combination of said first and second signals.

2. An ignition system according to claim 1, wherein the computation means outputs ignition signals to said ignition coil or coils in response to each said first signal during a first completed revolution of the engine.

3. An ignition system according to claim 1, wherein, at low engine speeds, the ignition signal consists of a plurality of pulses.

4. An ignition system according to claim 1, wherein the computation means further comprises means for monitoring operation of said means for generating the second signal, and for detecting incorrect operation of said second signal generating means.

5. An ignition system according to claim 4, wherein said monitoring means indicates a plurality of different incorrect operations.

6. An ignition system according to claim 5, further comprising store means for storing indications of the incorrect operations of said means for generating the second signal.

* * * * *